United States Patent [19]

Marsico

[11] 4,164,823

[45] Aug. 21, 1979

[54] LUMINOUS EFFECTS DEVICE

[76] Inventor: Joseph J. Marsico, 1229 Newberry Ave., LaGrange, Ill. 60525

[21] Appl. No.: 669,235

[22] Filed: Mar. 22, 1976

[51] Int. Cl.[2] ..... G09F 13/12; G09F 19/16

[52] U.S. Cl. ..... 40/427; 40/219; 350/291; 362/140; 362/811

[58] Field of Search ..... 40/106.52–106.53, 40/133 A, 132 E, 132 F, 132 D, 219, 130 L, 132 R, 130 R, 130 B, 28 B, 427, 442; 240/10 R, 10 L, 10.1; 350/291, 293, 296; 272/8 M, 8 D, 8 R; 362/135, 140, 806, 811

[56] References Cited

U.S. PATENT DOCUMENTS

| | | | |
|---|---|---|---|
| 2,221,889 | 11/1940 | White | 40/219 |
| 2,222,301 | 11/1940 | Rappaport | 40/563 X |
| 2,286,246 | 6/1942 | Yearta | 40/219 |
| 2,286,247 | 6/1942 | Yearta | 40/28 B X |
| 3,610,918 | 10/1971 | Barlow | 40/219 X |
| 3,736,832 | 6/1973 | Franke et al. | 40/106.52 X |
| 3,806,722 | 4/1974 | Peake et al. | 240/10 R |
| 3,915,457 | 10/1975 | Casey | 350/293 X |

FOREIGN PATENT DOCUMENTS

| | | | |
|---|---|---|---|
| 1229912 | 4/1971 | United Kingdom | 40/219 |

*Primary Examiner*—John F. Pitrelli
*Attorney, Agent, or Firm*—Schatzel & Hamrick

[57] ABSTRACT

A luminous effects device including a partially silvered mirror, a frusto-conical reflector having a plurality of lights disposed about its inner periphery and a spherical reflector, all of which are disposed within a closed container and aligned in series so that multiple reflections occur between the partially silvered mirror, frusto-conical reflector and spherical reflector to create an endless tunnel effect that can be viewed through the opposite side of the partially silvered mirror.

10 Claims, 3 Drawing Figures

LUMINOUS EFFECTS DEVICE

BACKGROUND OF THE INVENTION

Various types of luminous effects devices are known in the prior art and range from a simple flashing light or combination of lights to means for projecting moving spots on a surface with or without intensity modulation corresponding to input audio information. Although such devices are highly effective in stimulating sensory reactions in an observer, no prior art device known to Applicant has used a combination of mirrors in a closed compartment to create an illusion of depth and dimension substantially greater than is actually permitted by the size of the container.

SUMMARY OF THE PRESENT INVENTION

It is therefore an object of the present invention to provide a device which creates a three-dimensional illusion of depth using a combination of lights and reflective surfaces.

Another objective of the present invention is to provide a device which creates the optical illusion of an endless tunnel.

Still another object of the present invention is to provide a device which creates a three-dimensional optical illusion using audio intensity modulated lights in combination with various reflecting surfaces.

Briefly, the preferred embodiment of the present invention is comprised of a partially silvered mirror, a frusto-conical reflector having a plurality of lights disposed about its inner periphery and a spherical reflector, all of which are disposed within a closed container and aligned in series so that multiple reflections occur between the partially silvered mirror, frusto-conical reflector and spherical reflector to create an endless tunnel effect that can be viewed through the opposite side of the partially silvered mirror.

An advantage of the present invention is that it creates an illusion of substantial depth without requiring actual substantial device depth.

Another advantage of the present invention is that it may be made in any size ranging from a desk top curiosity to an entire wall-size display.

These and other objects and advantages of the present invention will no doubt become apparent to those skilled in the art after having read the following detailed disclosure of the preferred embodiment which is illustrated in the several figures of the drawing.

IN THE DRAWING

DETAILED DESCRIPTION OF THE PREFERRED EMBODIMENT

Figure 1:
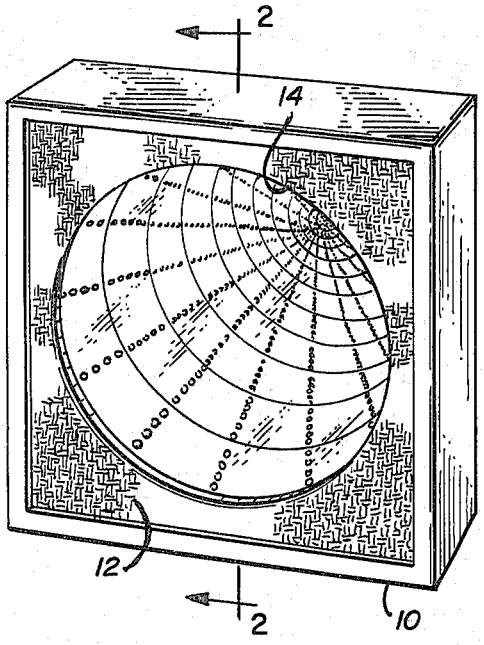
FIG. 1 is a perspective view showing the external configuration and the illusion created by the preferred embodiment.

Referring now to FIG. 1 of the drawing, there is shown a luminous effects device in accordance with the present invention which includes a rectangular housing 10 that may be constructed of wood, metal or plastic in any configuration suitable for fitting the intended utilization of the device. In the illustrated embodiment, housing 10 is actually square in front and has a decorative front panel 12 with a circular aperture 14 provided in the center thereof to serve as a viewing window for the device. The panel 12 serves as a mask for allowing light to pass out only through the aperture 14 and may be made of any suitable material. The exterior surface of panel 12 may have any design or fixture consistent with the desired external decor and intended use of the device.

Figure 2:
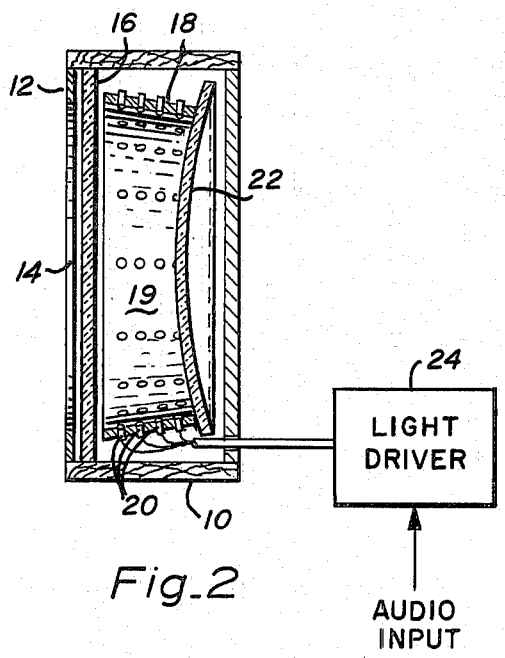
FIG. 2 is a transverse cross section taken along the line 2—2 of FIG. 1.
Figure 3:
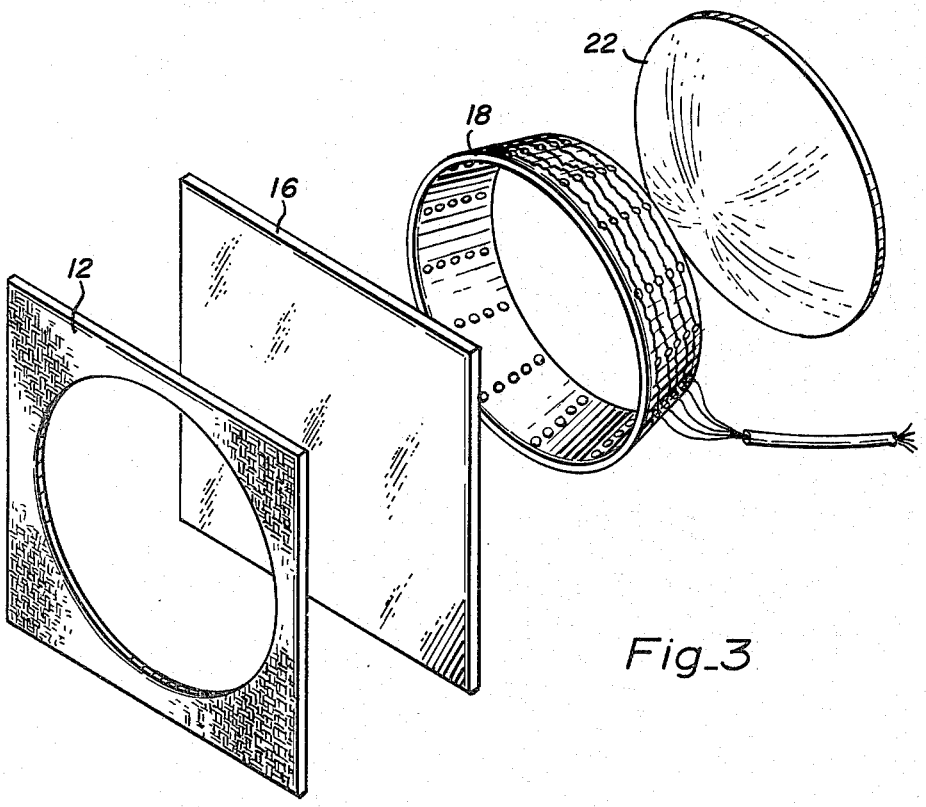
FIG. 3 is an exploded diagram illustrating the principal operative components of the preferred embodiment.

As further illustrated in the cross section shown in FIG. 2 and the exploded view of FIG. 3, positioned immediately behind the panel 12 is a partially silvered mirror 16, sometimes referred to as a two-way mirror. Positioned immediately behind mirror 16 is a frusto-conically shaped member 18 having its internal periphery 19 silvered or polished to a high luster. Although the preferred embodiment has a reflective surface 19, it will be appreciated that interesting visual effects could be achieved by making the surface 19 nonreflective, such as by painting it flat black, for example.

Disposed around the member 18 and extending through the surface 19 are a plurality of tiny lightbulbs, neon lamps or light effect devices (LEDs) 20 which are arranged in rows generally parallel to the central axis of member 18. However, such lights could alternatively be randomly positioned about member 18 or be spirally arrayed or otherwise situated to provide any desired illusion configuration or effect. The lights 20 are electrically connected to any suitable power supply or light driver 24. Light driver 24 may be a simple power supply, a flasher, a light sequencing device, an audio responsive light intensity modulating device or any other suitable light driving apparatus. In the preferred embodiment, light driver 24 is a device which responds to several frequencies and modulates the intensity of various combinations of the lights 20 in accordance with the detected intensity of an audio input.

Positioned immediately behind member 18 is a spherical convex reflector 22 having an outer diameter at least as large as the outer diameter of the back side of member 18. As will be appreciated by those skilled in the art, light emanating from the lamps 20 will experience multiple reflections between the reflective surface of mirror 16 and the reflective surface of spherical reflector 22 so as to create an image viewable through the opening 14 which appears to extend into infinity much as the interior of a pipe or tunnel appears to extend into infinity. The blinking or other intensity modulation further adds to the illusion, particularly when such modulation is caused by music that is audible to the observer.

It will, of course, be appreciated that the aperture 14 and configuration of member 18 need not be round but could alternatively be oval, elliptical, rectangular, or of any other suitable geometric configuration and still accomplish a similar effect. It will furthermore be appreciated that a wide range of sizes can be used for the device. For example, the device could be made in a small desk top size at one extreme, or could be made to fill an entire room wall at the other extreme. One can radily imagine the effect that could be created in a relatively small room if one wall were to appear to be displaced several hundred feet away.

By varying the vertex angle of the frusto-conical member 18 and/or the radius of curvature of spherical reflector 22, the angle of convergence of the tunnel-like illusion can be varied. It will also be appreciated that instead of using an actual spherical reflector, an approximation thereof in the form of a silvered Fresnel lens, sometimes referred to as a "Lensor," could be substituted therefor to achieve the same effect. The advantage of so doing would be to reduce costs and to achieve a slight improvement in the depth of the housing required to enclose the various components.

Whereas the present invention has been illustrated and described above in terms of a single preferred embodiment, it is to be understood that numerous alterations and modifications will be apparent to those skilled in the art after having read the preceding disclosure. Accordingly, it is intended that the following claims be interpreted as covering all such alterations and modifications as fall within the true spirit and scope of the invention.

What is claimed is:

1. A luminous effects device comprising:

means forming a housing closed on all but one side;

a first reflector means disposed within said housing and having its reflective side facing the open side of said housing;

a light means carrying member having a continous inside wall forming a frusto-conical section circumscribing a central region enclosed by said housing and having a first opening of a first diameter disposed adjacent said first reflector means, and a second opening of a second diameter which is larger than said first opening;

light means affixed to said carrying member and disposed proximate said inside wall; and a partially silvered, partially transpartent second reflector means disposed adjacent said second opening and serving to close the open side of said housing, whereby light from said light means reflected back and forth between said first reflector means and said second reflector means creates an illusion of depth when viewed through such second reflector means.

2. A luminous effects device as recited in claim 1 wherein said first reflector means is a convex spherical reflector.

3. A luminous effects device as recited in claim 2 wherein said light means includes a plurality of light bulbs disposed in rows generally parallel to the axis of said member.

4. A luminous effects device as recited in claim 3 and further comprising an audio signal responsive light driver means coupled to said light means and operative to modulate the intensity of various combinations of said light means in response to the frequency of an audio input signal.

5. A luminous effects device as recited in claim 1 wherein said housing further includes a front panel having an opening therein with a diameter substantially the same size as said second opening and coaxial therewith.

6. A luminous effects device as recited in claim 1 wherein said first reflector means is a silvered Fresnel lens.

7. A luminous effects device as recited in claim 1 wherein said light means includes a first plurality of electrically energizable light sources electrically connected together, and at least a second plurality of light sources electrically connected together, and further comprising a light driver means having a first means responsive to a first range of frequencies of an audio input signal and operative to drive said first plurality of light sources and a second means responsive to a second range of frequencies of an input audio signal and operative to drive said second plurality of light sources.

8. A luminous effects device as recited in claim 7 wherein said first reflector means is a convex spherical reflector.

9. A luminous effects device as recited in claim 8 wherein said carrying member is a frusto-conical section having a first diameter at said first opening which is smaller than a second diameter at said second opening.

10. A luminous effects device as recited in claim 1 wherein at least one of said reflector means has a curved reflecting surface.

* * * * *